US006149096A

United States Patent [19]

Hartley

[11] Patent Number: 6,149,096

[45] Date of Patent: Nov. 21, 2000

[54] REEL

[76] Inventor: Brian Hartley, 12 Oakley Avenue, Brockwell, Chesterfield, Derbyshire, S40 4D8, United Kingdom

[21] Appl. No.: 09/308,126

[22] PCT Filed: Nov. 12, 1997

[86] PCT No.: PCT/GB97/03106

§ 371 Date: May 13, 1999

§ 102(e) Date: May 13, 1999

[87] PCT Pub. No.: WO98/21138

PCT Pub. Date: May 22, 1998

[30] Foreign Application Priority Data

Nov. 14, 1996 [GB] United Kingdom ..... 9623713

[51] Int. Cl.[7] ..... B65H 75/34

[52] U.S. Cl. ..... 242/390.9; 191/12.2 A

[58] Field of Search ..... 242/390.9, 390.6; 191/12.2 A

[56] References Cited

U.S. PATENT DOCUMENTS

| | | | |
|---|---|---|---|
| 4,504,023 | 3/1985 | Lauritzen | 242/390.9 |
| 4,666,102 | 5/1987 | Colbaugh et al. | 242/390.9 |
| 4,721,833 | 1/1988 | Dubay | 242/390.8 |
| 4,825,986 | 5/1989 | Pepper | 191/12.2 A |
| 4,842,108 | 6/1989 | Anderson et al. | 242/390.8 |
| 5,034,571 | 7/1991 | Galloway | 191/12.2 A |
| 5,647,554 | 7/1997 | Ikegami et al. | 191/12.2 A |
| 5,775,473 | 7/1998 | Cordero | 191/12.2 A |

FOREIGN PATENT DOCUMENTS

| | | |
|---|---|---|
| 0 216 582 | 4/1987 | European Pat. Off. . |
| 57-23557 | 6/1980 | Japan . |

*Primary Examiner*—John M. Jillions
*Attorney, Agent, or Firm*—Smith-Hill and Bedell

[57] ABSTRACT

A reel (10) for cable (21) has a drum (24) onto which the cable (21) may be wound. An electric motor (41) can turn the drum (24) to pull cable (21) in but the drum (24) can also pivot at (65) when the cable (21) is pulled or released. This rocking motion is sensed to switch the motor (41) on or off, thereby allowing slack cable (21) always to be taken up, but preventing the motor (41) resisting cable (21) paying out when required.

9 Claims, 9 Drawing Sheets

REEL

The present invention relates to reels for elongate members and in particular, but not exclusively, to reels for electric cable.

Electric cable extension reels have previously been proposed for use when machinery or other apparatus does not have sufficient cable fitted to reach the main electricity supply. The cable reel provides an extension, allowing power to reach the machinery.

Several types of cable extension reel have been proposed. A simple version consists of a drum with cable wound around it, the cable having a plug fitted to one end and a socket fitted to the other end and the cable being manually wound onto the drum when not in use. This arrangement can result in loose cable lying on the ground, possibly becoming tangled in machinery with consequent risk of damage or danger, such as electrocution of the machine operator. An alternative proposal uses springs to rewind the cable when not in use but these arrangements have been found too heavy to be portable and thus need to be mounted at a fixed position, making them less useful than a portable extension cable.

The present invention seeks to obviate or mitigate these or other disadvantages of the prior art.

According to the invention, there is provided a reel for an elongate member, comprising a rotatable member onto which the elongate member may be wound and from which it may be unwound, support means on which the rotatable member is mounted, drive means operable to turn the rotatable member and control means operable to control the drive means, the control means being operable to sense slackness in the elongate member and to turn the rotatable member to take up the slack, and being operable to sense tautness in the elongate member and to cause the drive means to cease turning the rotatable member, to allow the elongate member to be unwound from the rotatable member, the drive means comprising an electric motor and the control means comprising switch means which operates when the elongate member becomes slack or taut, thereby causing the electric motor to turn or to cease to turn the rotatable member.

Preferably the rotatable member is mounted to move relative to the support means by a second movement other than turning to wind the elongate member and to do so in response to the elongate member becoming taut, the switch means sensing the second movement to control the drive means.

Preferably the rotatable member is mounted to rock relative to the support member about an axis spaced from the axis about which the rotatable member turns to wind, the arrangement being such that tautness in the elongate member causes the rotatable member to rock in a first direction and such that slackness allows the rotatable member to rock in the second, reverse direction.

The apparatus may further comprise second switch means operable in response to second movement of a magnitude greater than is required to operate the first switch means, the second switch means being operable to disable and re-enable the drive means.

Preferably the elongate member is an electric cable. The drive means may be powered by the supply conveyed by the electric cable. The operating speed of the drive means is preferably adjustable.

Preferably the elongate member carries a third switch at its remote end and operable to disable the drive means.

Preferably the support means comprises a switching portion operable to operate the third switch as the third switch approaches the rotatable member during winding, thereby disabling the drive means. The switching portion may define an aperture through which the elongate means passes when being wound, the aperture walls engaging the third switch means as it passes, to operate the switch. The third switch means may be a rocker switch and the clearance within the aperture may be restricted to cause the switch to rock as it passes through the aperture in either direction.

Embodiments of the present invention will now be described in more detail, by way of example only, and with reference to the accompanying drawings, in which.

Figure 1:
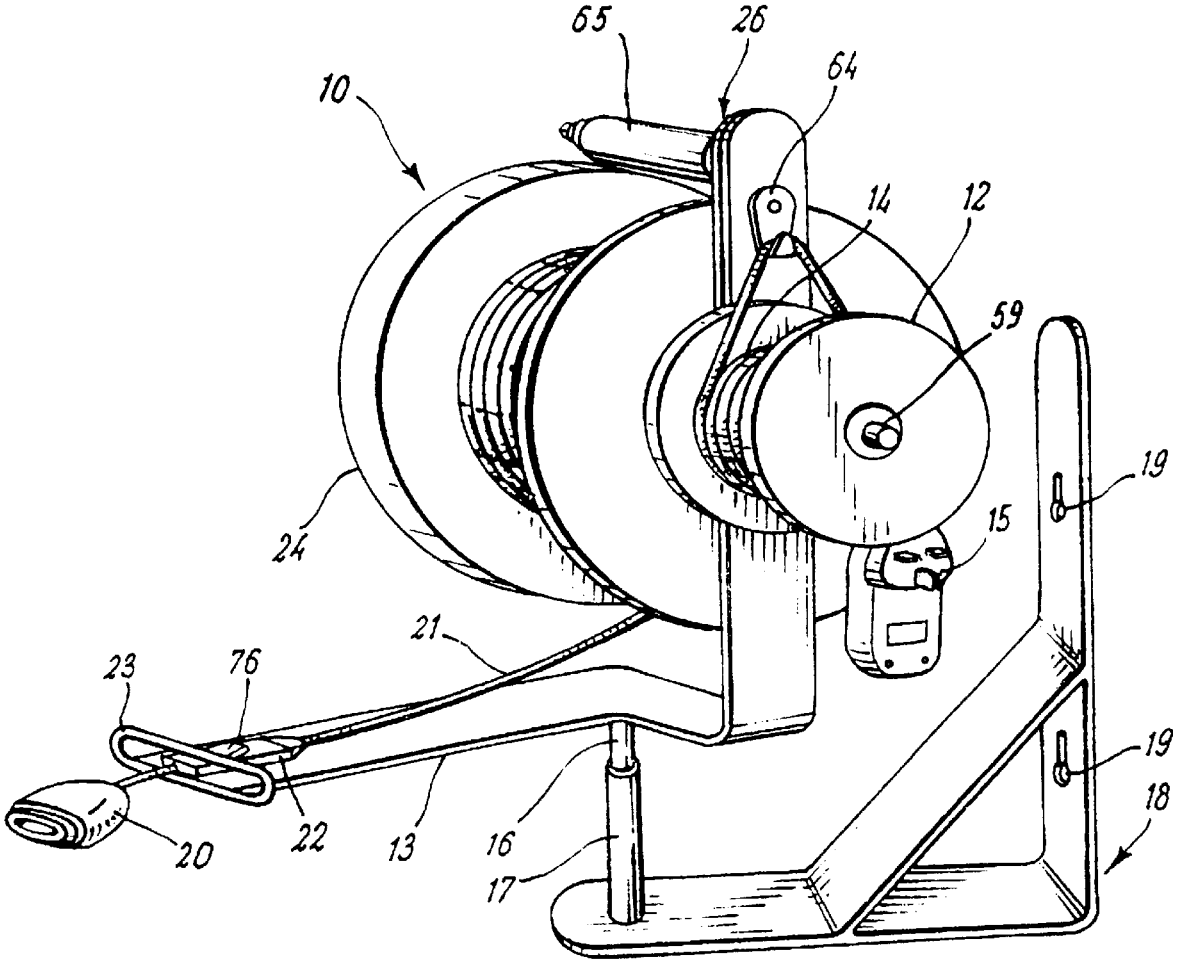
FIG. 1 is a perspective view of a first embodiment of the invention.

The drawings show a reel 10 for an elongate member such as a cable 21. The reel 10 comprises a rotatable member in the form of a drum 24 onto which the cable 21 may be wound and from which it may be unwound. Support means, including a bracket 13 and pin 16 support the drum 24. Drive means in the form of an electric motor to be described in more detail below, is operable to turn the drum 24 subject to the control of various means, primarily including various switches to be described in more detail. The control means are used to sense slackness in the cable 21 and to turn the drum 24 to take up the slack.

Considering FIG. 1, the drum 24 holds the main length of cable 21 and is supported on the bracket 13 to rotate about its axis to allow cable 21 to run off the drum or be wound back on to it. The cable 21 passes away from the drum through a slot 23 and has a free end to which a socket 20 is attached. The drum 24 and slot 23 are mounted on the bracket 13 which in turn has a depending pin 16 forming a swivel connection with a length of tubing 17 for wall mounting by means of a bracket 18 having screw holes 19.

The bracket 13 also carries a secondary drum 12 having a relatively short length of cable 14 wound therearound and carrying a plug 15 for connection to a mains electricity outlet in the vicinity of the bracket 18. A clip 64 may help keep cable tidy. The cable 14 is connected by means to be described to the cable 21 to allow continuous electrical connection while the drum 24 is rotating.

A hand grip 65 is provided, by means of which the reel 10 may be carried.

Figure 2:
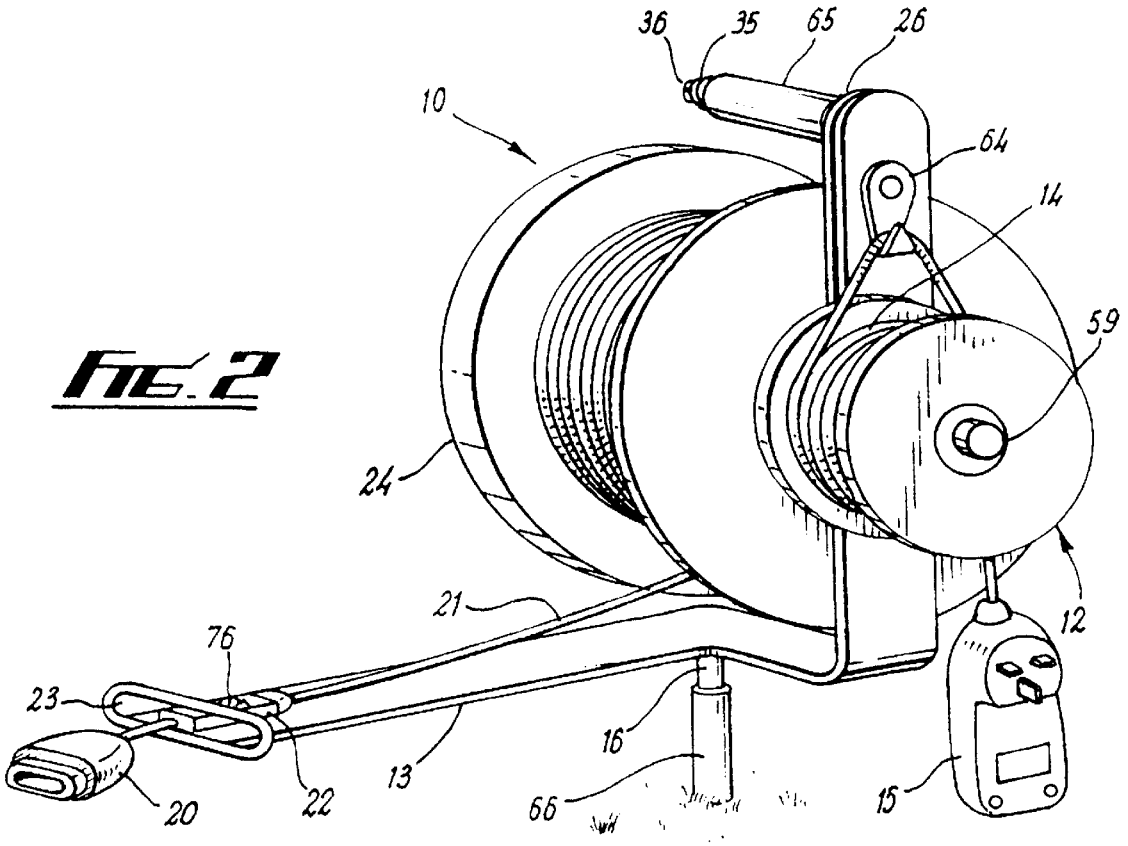
FIG. 2 shows an alternative version of the embodiment of FIG. 1, supported on the ground by means shown in FIG. 3.
Figure 3:
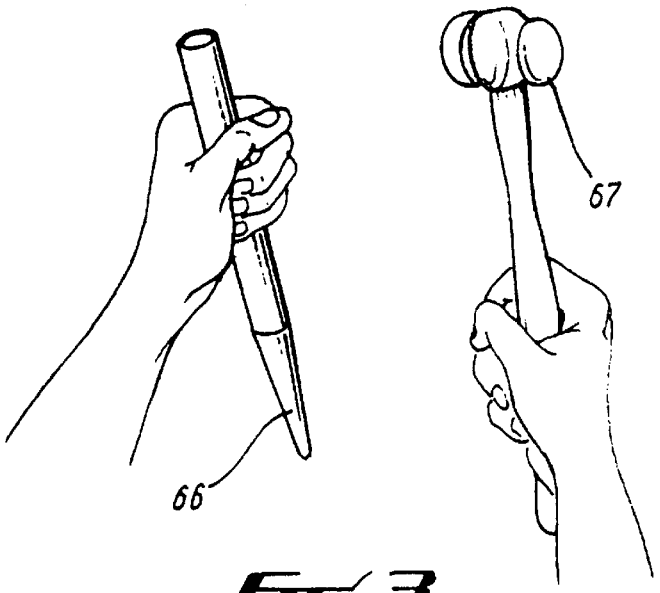

In an alternative version shown in FIG. 2, the pin 16 is in a hollow spike 66 driven into the ground, such as by a hammer 67, the spike and hammer being shown in FIG. 3. This allows the reel 10 to be used portably at a variety of locations where the spike 66 can be driven in, but these locations need to be sufficiently close to a mains electricity outlet to allow the plug 15 to be connected.

Figure 4:
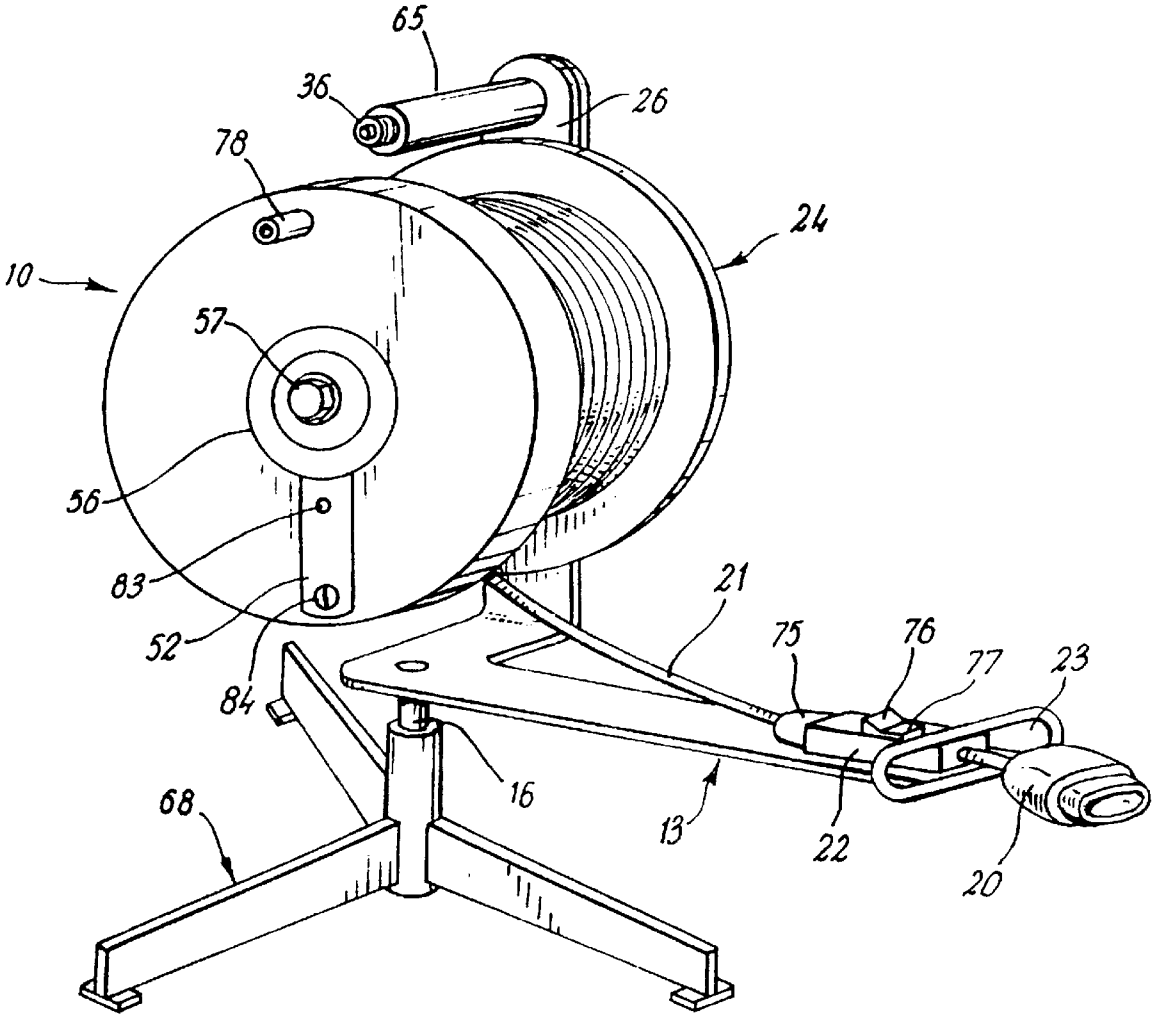
FIG. 4 shows a further alternative version of the embodiment of FIG. 1.
Figure 5:
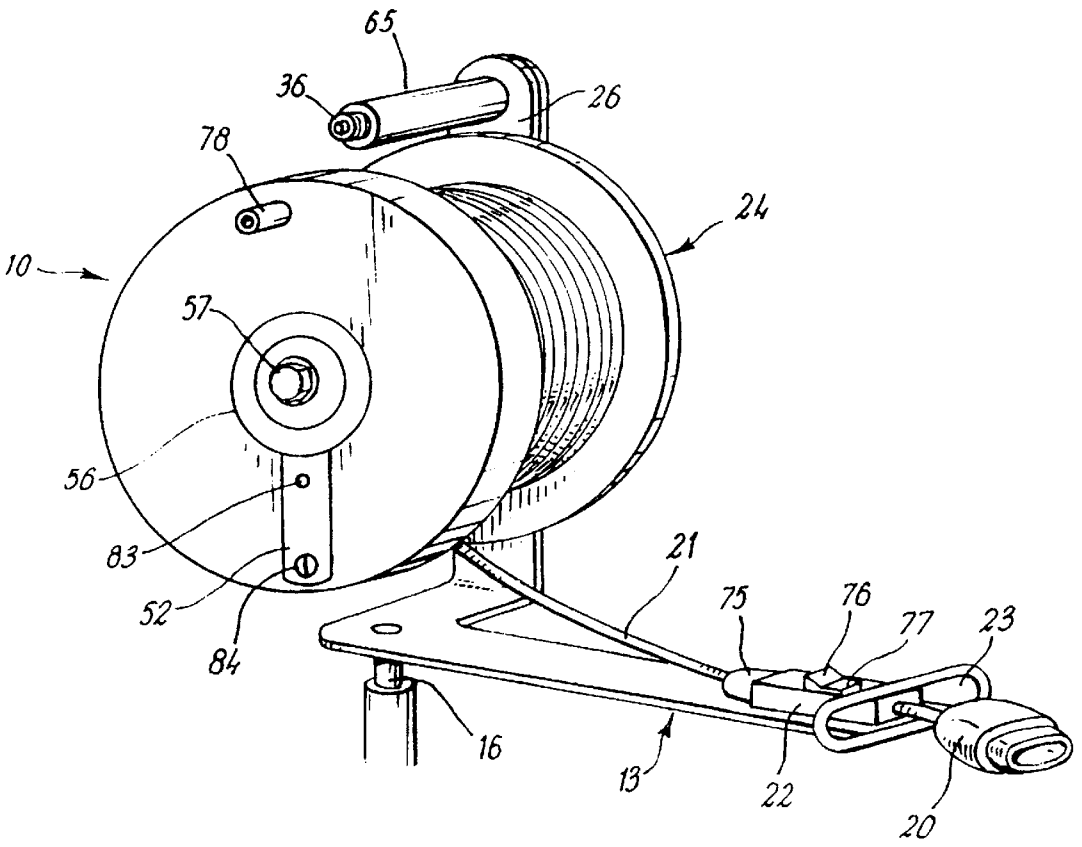
FIG. 5 is a further perspective view of the version of FIG. 2, viewed from the other direction.

A further alternative version is shown in FIG. 4, in which the pin 16 is used to support the reel 10 on a stand 68.

Close to the end of the cable 21, before the socket 20, the cable has a rocker switch 22 having a rocking switching member 76, 77. The slot 23 is sufficiently narrow as to engage the switching member 76, 77 as the switch 22 passes through the slot 23, thereby causing the switch 22 to be switched on or off on each occasion, as will be described.

In addition to providing a handle 65, the arrangements at the top of the bracket 13 provide an axis spaced from the rotation axis of the drum 24, but about which the drum 24 can rock for purposes to be described. That is to say, the rotation axis of the drum 24 is not fixed relative to the bracket 13, but can move as the drum 24 rocks about the axis of the hand grip 65. The detailed internal arrangements by which this is achieved are shown in more detail in FIG. 6.

Figure 6:
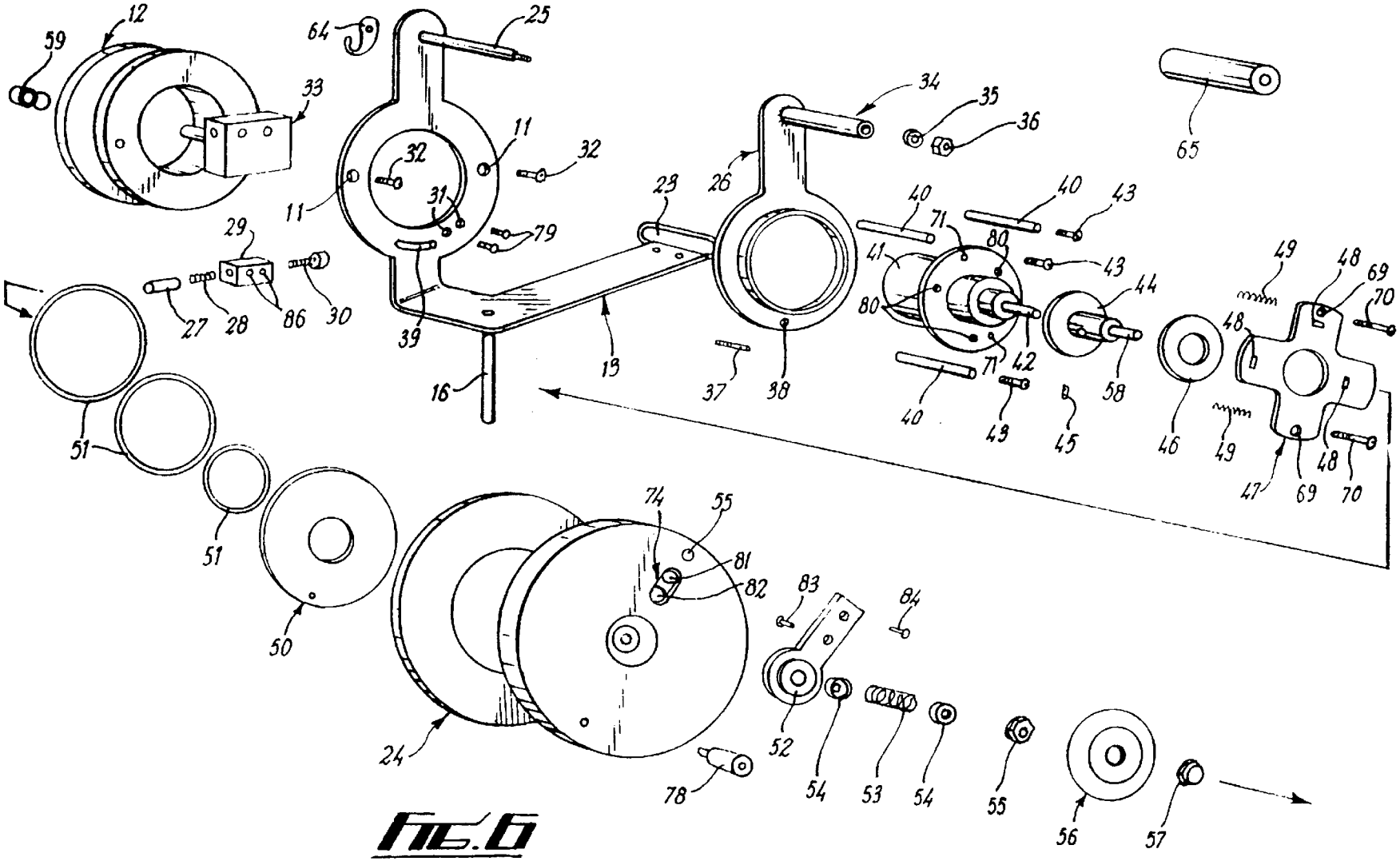
FIG. 6 is an exploded view of the first embodiment.

As shown in FIG. 6, the upper end of the bracket 13 carries a projecting pin 25 on which a rocking frame 26 is supported by means of a tube 34 which fits over the pin 25 and is retained by a washer 35 and nut 36.

Figure 7:
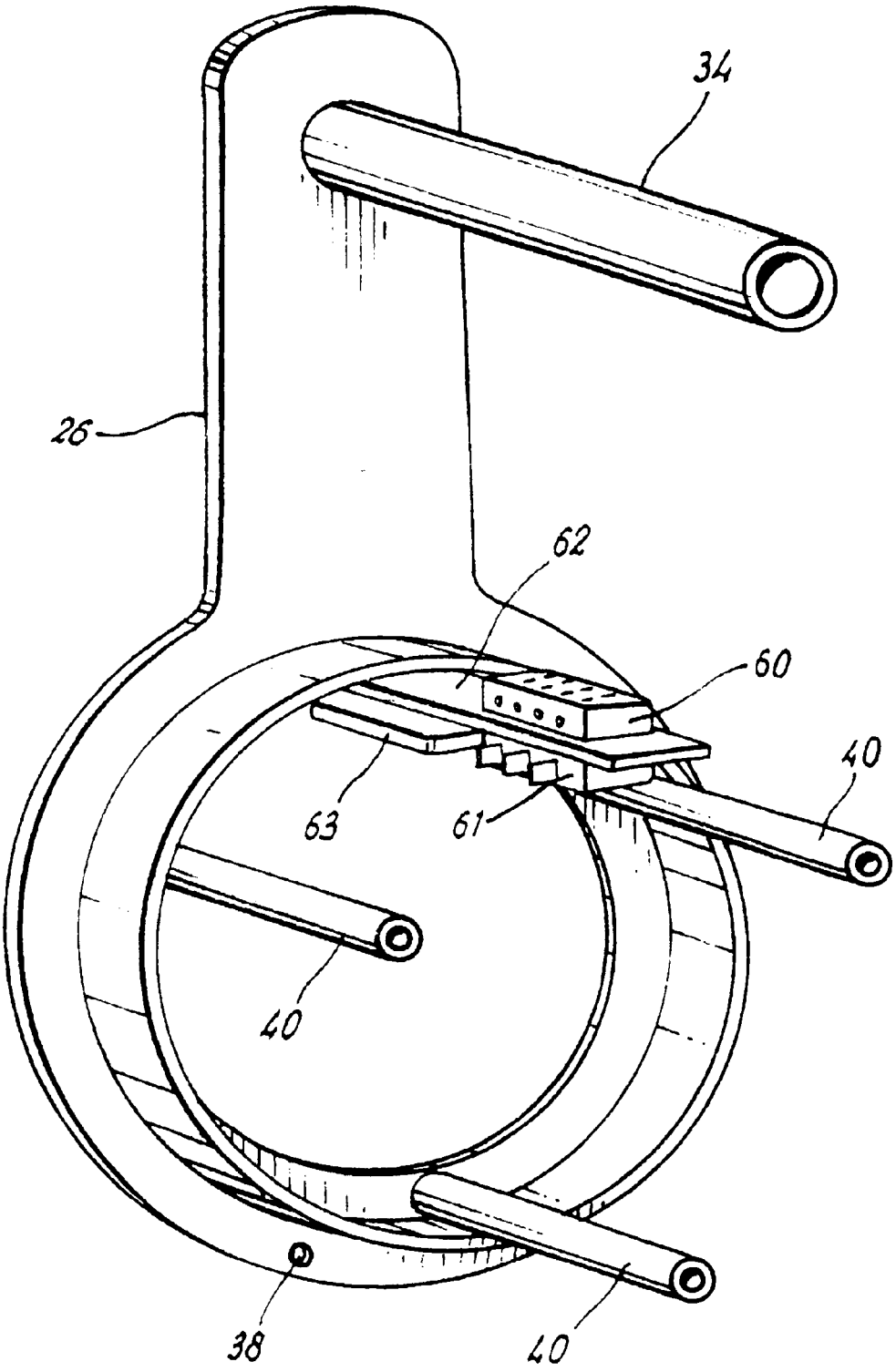
FIG. 7 shows the rocking bracket of the embodiment, on an enlarged scale.
Figure 9:
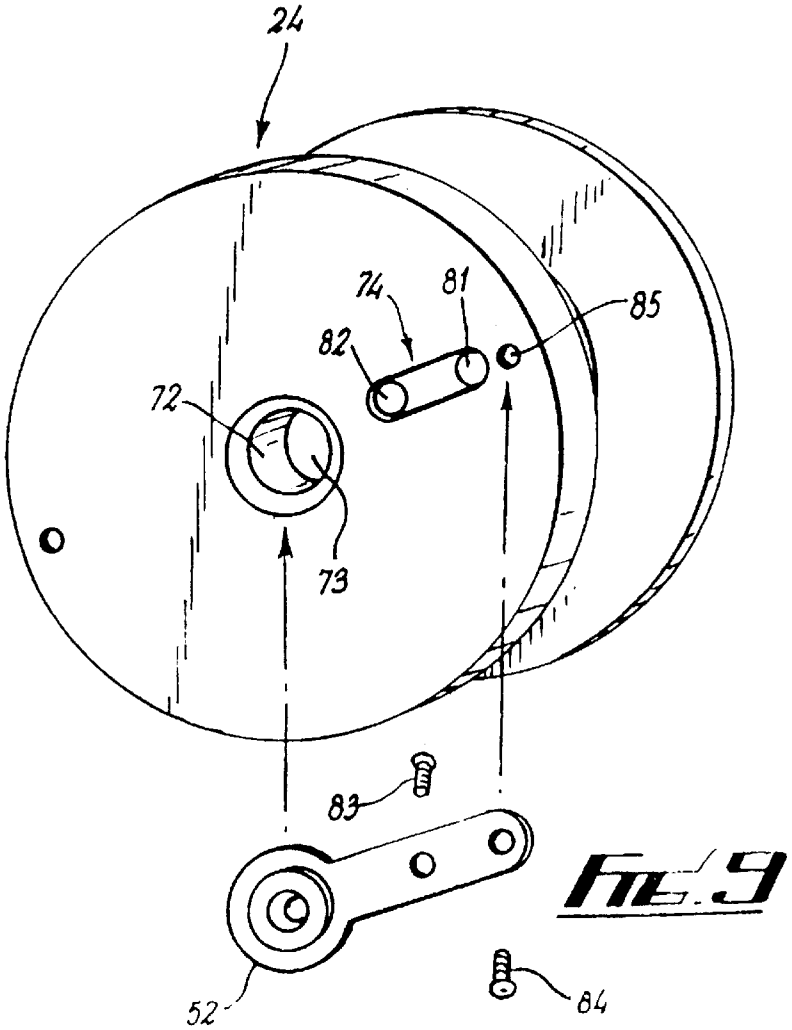
FIGS. 8 and 9 are perspective views from the front and rear showing the drum on which cable is wound.
Figure 8:
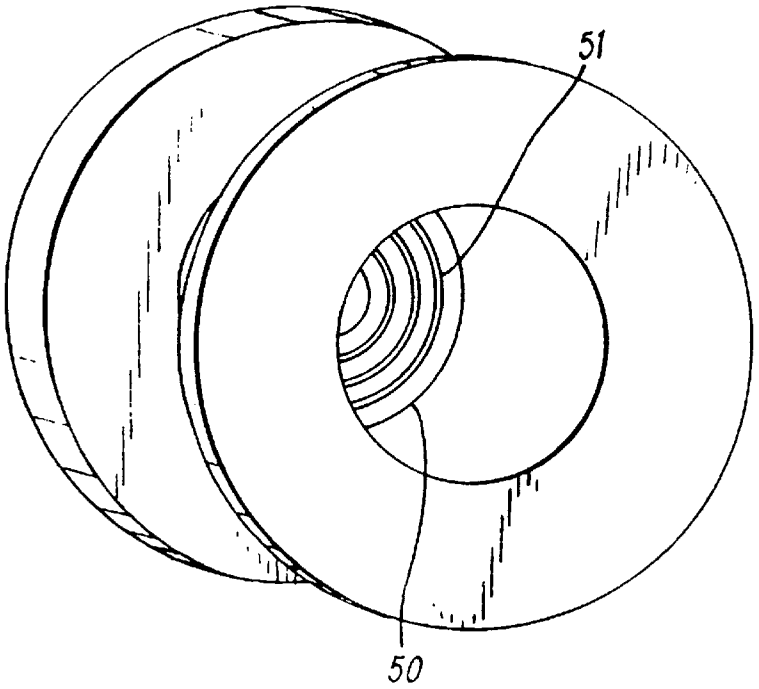

The drum 24 is mounted on the frame 26 by means of the motor 41 and associated components. First, three tubes 40 attached around the frame 26 (see FIG. 7) receive screws 43 which, having passed through a flange around the motor 41, mount the motor to the frame 26. The motor shaft 42 carries an adapter 44 attached to the shaft 42 by a grub screw 45. A rubber washer 46 fits over the adapter to turn with it and a piece of insulation board 47 fits loosely over the adapter to be held in position by two screws 70 through holes 69 and screwed to the motor flange at 71 to bear against bias springs 49.

The adapter 44 carries a projecting spindle 58 to be engaged by washers 54, nut 55, cover 56 and lock nut 57 to hold the drum 24 in position surrounding the motor 41.

A further circular board 50 is mounted centrally within the drum 24 and attached to it so that tightening the nut 55 on the spindle 58 presses the drum 24 toward the frame 26 and also presses the board 50 against the board 47. Both boards 47, 50 bear conductive tracks for providing electrical connections through the device, as will be described.

It will be appreciated from the above that the frame 26, motor 41 and drum 24, together with the associated components, form a unit which, while allowing the drum 24 to rotate about the axis of the motor and relative to the frame 26, can also rock as a complete unit about the axis of the pin 2. The significance of this can now be explained by reference to FIGS. 6 and 7.

First, a block 29 is mounted on the bracket 13 by screws 79 and holes 86 and 31. The block 29 houses a spring 28 which urges a plunger 27 toward the left as shown in FIG. 6 and under control of an adjustment screw 30 which sets the spring tension. The plunger 27 is urged toward a slot 39 in which a pin 37 runs, the pin being permanently fixed in a hole 38 in the frame 26. Thus, as the frame 26 rocks, the pin 37 moves along the slot 39, influenced by biasing provided by the plunger 27 and spring 28. The frame 26 also carries a microswitch 61 (FIG. 7) mounted on a metal strip 62 and having an operating arm 63 which bears against the bracket 13 so that the switch is opened and closed by the rocking movement of the frame 26. Thus, the rocking movement of the frame 26 is sensed by the microswitch 61, which is in turn used to control the motor 41.

In use, when cable 21 is being drawn off the drum 24 by hand, pulling the socket 20 away from the reel 10, the reel 24 will rock toward the slot 23, switching the switch 61 to its open condition and in this condition, by virtue of the circuit diagram of FIG. 10 to be described below, power to the motor 41 is switched off and the drum 24 is free to turn to pay out cable 21. As cable is being pulled out, it will be taut and thus able to overcome the bias provided by the spring 28 and plunger 27. However, as soon as the cable is allowed to go slack, for instance because no further cable is required to be pulled out or the operator begins to move back toward the reel, the bias provided by the spring 28 will urge the plunger to push the pin 37, thus rocking the frame 26 back away from the slot 23, causing the switch 61 to be closed and thus re-connect the motor 41 to power. The motor then causes the drum 24 to start turning in the sense which causes the slack cable 21 to be rewound onto the drum 24. Once the cable is again taut, the frame 26 will rock back, opening the switch 61 and turning off the motor.

Thus, whenever additional cable is required, it can be drawn from the reel without resistance by the motor, but as soon as the cable goes slack, the spare is drawn in to re-tauten the cable.

The electrical connections through the device can now be described. Power from the plug 15 is fed through the cable 14 to a terminal block 60 (FIG. 10) carried on the frame 26. From there, conductors connect the supply to three contacts 48 on the board 47 (which is fixed relative to the frame 26). The contacts 48 bear against contact rings 51 carried by the board 50 which itself turns with the drum 24. One end of the cable 21 is connected to the contacts 51, to supply the socket 20. Thus, as the drum 24 rotates, the contacts 48, 51 maintain continuous electrical supply from the plug 15 to the socket 20. The cable 21 may protrude out through hole 81 and back to the centre of the drum 24 through hole 82 to allow for connection in this way.

The motor 41 is also fed from the same supply through the switch 61 and an optional variable resistance 33 to control motor speed and controlled by knob 59 (FIG. 1).

Figure 10:
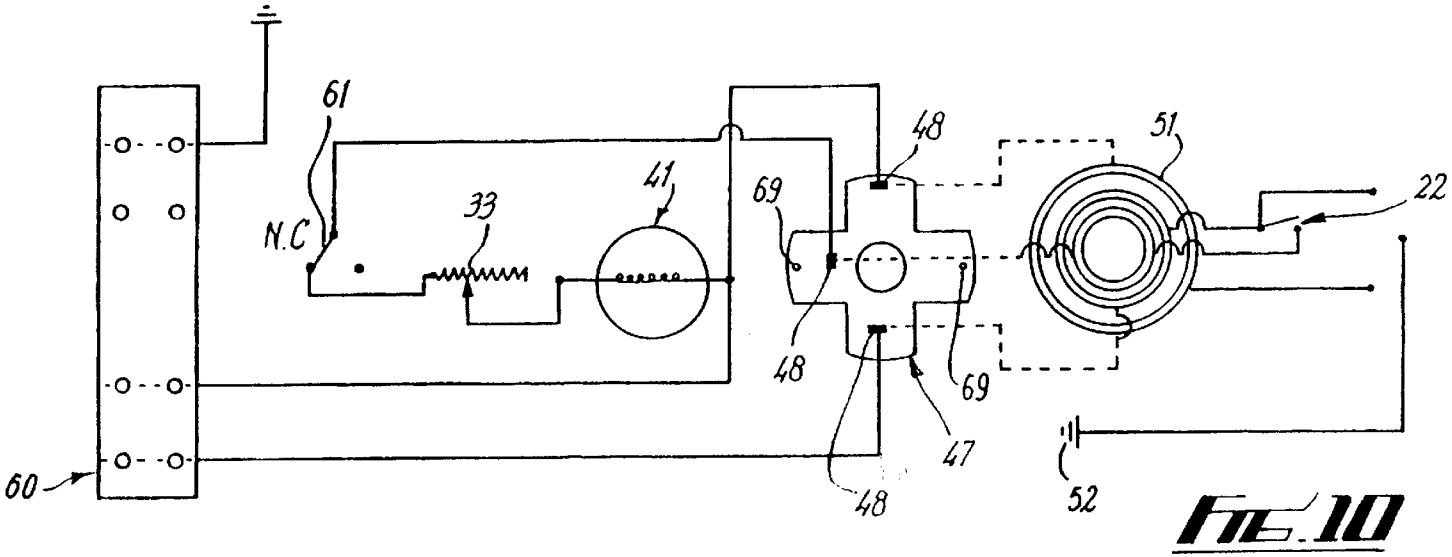
FIG. 10 is a highly schematic wiring diagram for the first embodiment.
Figure 12:
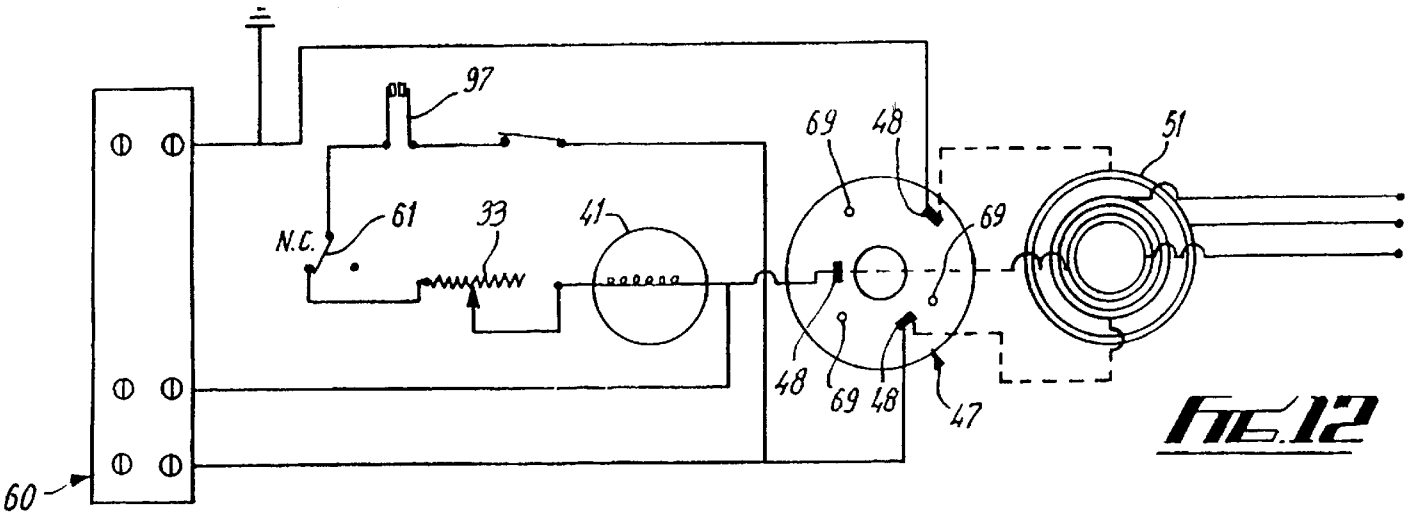
FIG. 12 is a schematic wiring diagram for the second embodiment.

It may also be desirable for the motor to be further controlled by the rocker switch 22, as indicated in FIG. 10, where the switch 22 is shown connecting two power rails which must be connected before the motor 41 is powered. Thus, as cable is drawn out through the slot 23, thus operating the switch 22, the motor 41 can be powered, subject to the status of the switch 61 or can be permanently disabled by manual operation of the switch 22. On retraction, once the cable 21 is fully retracted and the switch 22 passes through the slot 23, the switch 22 will be switched off to disable the motor from further effort.

Appropriate arrangements for earthing can be made, such as by providing a plate 52 attached to the drum 24 by screws 84 into holes 85, and connected in a manner similar to that described above, through to an earth provided by the electrical mains supply. The plate has an aperture to fit over the projection 58 and retain the reel in position.

The arrangements between the drum 24 and the motor 41, particularly a presence of the spring 53, provide a simple clutch function which ensures that the drum 24 can stop turning once the cable has become wound tight, to prevent damage to the cable by over tightening. A thermal sensor could be associated with the motor 41 to prevent overheating.

The motor, when disconnected from supply, will act as a brake, thus stopping the drum quickly once the operator has stopped pulling the cable, and preventing the drum from over-running to cause cable to become tangled.

The socket 20 could be fitted with a cover, such as a spring cover, for protection. The drum is preferably used for electric cable, but could be used for other elongate articles such as rope, string or other materials. In that case, the circular electrical connections and the like would not be necessary, but the microswitch 61 would still be used to control the device as described above. Alternatively, arrangements could readily be made to wire the apparatus differently, to provide connections for single or multiple phase electrical supply, with or without earth or other features.

Figure 11:
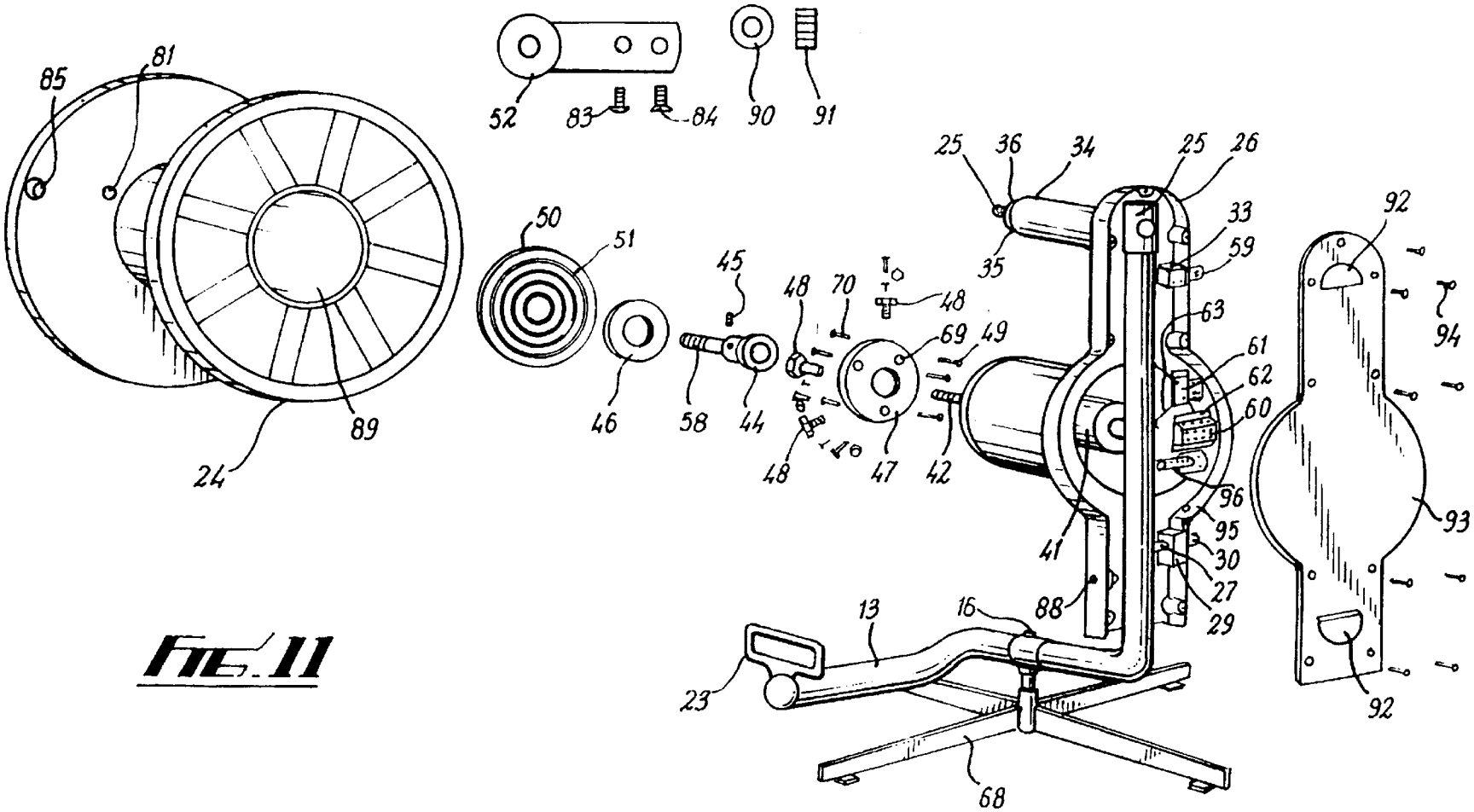
FIG. 11 is an exploded view corresponding to FIG. 6 and showing a second embodiment.

FIG. 11 shows a second embodiment in which many features are the same as or closely correspond to features of the embodiments described above and are thus given the same numerals. The principal changes in this embodiment concern the rocking frame which is now replaced by a unitary moulded housing for the motor 41 and around which the drum 24 can turn, the housing still being able to rock (at 25) on the bracket 13, now formed from tubular material. The bracket 13 extends up into the housing, which is covered by a plate 93 attached by screws 94 and carrying hooks 92 around which spare cable can be coiled, if required.

Within the housing, an additional switch 96 is provided, for the following reason. If the housing is rocked past the position at which the switch 61 disables the motor 41, the switch 96 then bears on the bracket 13. The switch 96 is a latching switch, requiring operation to switch on and then further operation to switch off again. Consequently, by sharply tugging on the cable to rock the housing past the operating position of the switch 61, the operator can cause the switch 96 to toggle on or off. The switch 96 is wired in series with the switch 61, thereby disabling the motor when off. This allows the user to pull off some slack cable when required, by a sharp tug and then subsequently pulling cable more gently. A further sharp tug will restore the arrangement to its normal operating condition as described above, in which the cable is kept taut.

In any of these embodiments, two, three or four core cable could be used, subject to the usual safety requirements and the like, as could multiple phases. The rocker switch 22 could be used or omitted and many other variations could be made without departing from the scope of the invention.

What is claimed is:

1. A reel for an elongate member, comprising:

a rotatable member onto which the elongate member may be wound and from which it may be unwound, support means on which the rotatable member is mounted, drive means operable to turn the rotatable member, and control means operable to control the drive means, the control means being operable to sense slackness in the elongate member and to turn the rotatable member to take up the slack, and being operable to sense tautness in the elongate member and to cause the drive means to cease turning the rotatable member to allow the elongate member to be unwound from the rotatable member, the drive means comprising an electric motor and the control means comprising first switch means which operates when the elongate member becomes slack or taut, thereby causing the electric motor to turn or to cease to turn the rotatable member, the rotatable member being mounted to move relative to the support means by a second movement other than turning to wind the elongate member and to do so in response to the elongate member becoming taut, the first switch means sensing the second movement to control the drive means, and the reel further comprising second switch means operable in response to second movement of a magnitude greater than is required to operate the first switch means, the second switch means being operable to disable and re-enable the drive means.

2. A reel according to claim 1, wherein the elongate member is an electric cable.

3. A reel according to claim 1, wherein the drive means is powered by the supply conveyed by the electric cable.

4. A reel according to claim 1, wherein the operating speed of the drive means is adjustable.

5. A reel according to claim 1, wherein the elongate member carries a third switch at its remote end and operable to disable the drive means.

6. A reel according to claim 5, wherein the support means comprises a switching portion operable to operate the third switch as the third switch approaches the rotatable member during winding, thereby disabling the drive means.

7. A reel according to claim 6, wherein the switching portion defines an aperture through which the elongate means passes when being wound, the aperture walls engaging the third switch means and it passes, to operate the switch.

8. A reel according to claim 5, wherein the third switch means is a rocker switch and the clearance within the aperture is restricted to cause the switch to rock as it passes through the aperture in either direction.

9. A reel according to claim 1, wherein the rotatable member is mounted to rock relative to the support member about an axis spaced from the axis about which the rotatable member turns to wind, the arrangement being such that tautness in the elongate member causes the rotatable member to rock in a first direction and such that slackness allows the rotatable member to rock in the second, reverse direction.

* * * * *